US010847932B2

(12) United States Patent
Teramoto

(10) Patent No.: US 10,847,932 B2
(45) Date of Patent: Nov. 24, 2020

(54) LEVER-TYPE CONNECTOR

(71) Applicant: Sumitomo Wiring Systems, Ltd., Mie (JP)

(72) Inventor: Keisuke Teramoto, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/744,436

(22) Filed: Jan. 16, 2020

(65) Prior Publication Data

US 2020/0251856 A1 Aug. 6, 2020

(30) Foreign Application Priority Data

Feb. 1, 2019 (JP) ..... 2019-016793

(51) Int. Cl.
*H01R 13/62* (2006.01)
*H01R 13/629* (2006.01)

(52) U.S. Cl.
CPC . *H01R 13/62938* (2013.01); *H01R 13/62955* (2013.01)

(58) Field of Classification Search
CPC ..... H01R 13/62938; H01R 13/6275; H01R 23/7068; H01R 13/62933; H01R 13/641
USPC ..... 439/157, 357, 924.1, 372, 489
See application file for complete search history.

(56) References Cited

U.S. PATENT DOCUMENTS 4,867,699 A * 9/1989 Oda ..... H01R 13/64 439/355
5,055,058 A * 10/1991 Nagasaka ..... B60R 21/0173 439/188
5,131,865 A * 7/1992 Taguchi ..... H01R 13/641 439/188
5,582,180 A * 12/1996 Manset ..... A61B 5/04286 600/508
5,913,691 A * 6/1999 Clark ..... H01R 13/641 439/157
6,817,888 B2 * 11/2004 Kozono ..... H01R 13/62933 439/468

FOREIGN PATENT DOCUMENTS

JP 2013-020904 1/2013

* cited by examiner

*Primary Examiner* — Phuong Chi Thi Nguyen
(74) *Attorney, Agent, or Firm* — Gerald E. Hespos; Michael J. Porco; Matthew T. Hespos

(57) ABSTRACT

A connector includes a housing (14) with a lever (18) that is rotatable between an initial position and a connection end position for connection to a mating housing (12). The lever (18) includes a resilient piece (30) cantilevered parallel to the outer surface (16) of the housing (14). A projecting wall (38) projects toward the resilient piece (30) from a peripheral wall (32) surrounding the resilient piece (30). The resilient piece (30) has a locking surface (40A) extending toward a base of the resilient piece (30), and the housing (14) has a locked surface (22A) extending toward a tip of the resilient piece (30). The resilient piece (30) enters a clearance between the projecting wall (38) and the outer surface of the housing (14) when the lever (18) is urged from the initial position to the connection end position with the locking surface (40A) locked to the locked surface (22A).

6 Claims, 12 Drawing Sheets

LEVER-TYPE CONNECTOR

BACKGROUND

Field of the Invention

This disclosure relates to a lever-type connector.

Related Art

Japanese Unexamined Patent Publication No. 2013-20904 discloses a lever-type connector. This lever-type connector includes a male housing and a female housing to be connected to each other, and a lever is mounted on the male housing. The male housing is provided with a locking hole, and the lever is provided with a resilient locking piece. A locking portion projects on the resilient locking piece.

At an initial position of the lever, the locking portion of the resilient locking piece is accommodated in the locking hole of the male housing. If an attempt is made to rotate the lever at the initial position of the lever, the locking portion of the resilient locking piece hits a side wall of the locking hole of the male housing. In this way, a rotational displacement of the lever is suppressed and the lever is held at the initial position.

However, if the lever is pressed strongly in a rotating direction at the initial position of the lever, the locking portion of the resilient locking piece strongly hits the side wall of the locking hole of the male housing. Thus, the locking portion can ride on an opening edge of the locking hole to displace the lever from the initial position.

This disclosure was completed on the basis of the above situation and aims to reliably hold a lever at an initial position.

SUMMARY

This disclosure is directed to a lever-type connector with a housing to be connected to a mating housing. A lever is mounted on an outer surface of the housing and is rotatable between an initial position where the lever is located before connection to the mating housing is started and a connection end position where the lever is located when connection to the mating housing is completed. The lever includes a resilient piece cantilevered parallel to the outer surface of the housing and a projecting wall projects toward the resilient piece from a peripheral wall surrounding the resilient piece. The resilient piece has a locking surface extending toward a base end of the resilient piece to approach the outer surface of the housing. The housing has a locked surface extending toward a tip of the resilient piece at distance from the outer surface of the housing. The resilient piece enters a clearance between the projecting wall and the outer surface of the housing when the lever is rotated from the initial position to the connection end position with the locking surface and the locked surface locked together. Thus, the locking surface of the resilient piece is locked to the locked surface of the housing, to prevent rotation of the lever from the initial position toward the connection end position.

Accordingly, the present disclosure provides a lever-type connector capable of reliably holding a lever at an initial position.

If the lever at the initial position is pressed strongly toward the connection end position, the locking surface of the resilient piece is urged in a direction to separate from the locked surface. However, the locking surface of the resilient piece may be reverse-tapered to incline toward the base end while approaching the outer surface of the housing, thereby resisting separation of the locking surface from the locked surface. The resilient piece can enter the clearance between the projecting wall and the outer surface of the housing. Thus, the projecting wall also prevents separation of the locking surface from the locked surface to hold the lever reliably at the initial position.

The lever may include a shaft hole to receive a shaft projecting on the outer surface of the housing. The locking surface is oblique to the locked surface to start locking the locked surface from an outer side distant from the shaft at the initial position. Thus, a gap is formed between the locking surface and the locked surface at the initial position. However, the resilient piece is pushed toward the clearance between the projecting wall and the outer surface of the housing when the lever is pressed strongly. If the gap is eliminated and the locking surface and the locked surface are locked strongly to each other, a locked state of the locking surface and the locked surface can be maintained even if a large force is generated to separate the locking surface from the locked surface.

The resilient piece has two side edges, and a tip edge couples tips of the side edges. A base end of the side edge near the projecting wall is closer to the tip edge than a base end of the side edge distant from the projecting wall. Deflection of the resilient piece toward the projecting wall applies a tensile load to the side edge distant from the projecting wall and applies a compressive load to the side edge near the projecting wall. Generally, resin is weaker against a tensile load than against a compressive load and easily breaks by a tensile load. Here, the base end of the side edge near the projecting wall is closer to the tip edge than the base end of the side edge distant from the projecting wall. Thus, a length of the side edge distant from the projecting wall from the base end to the tip is longer than a length of the side edge near the projecting wall from the base end to the tip. Therefore, a tensile load applied to the base end of the side edge distant from projecting wall is dispersed in a wider range to suppress breakage of the resilient piece due to the tensile load.

The resilient piece is provided so that an axis passing through a center on a tip side is more distant from the projecting wall than an axis passing through a center on a base end side. If the resilient piece is pulled strongly according to the rotation of the lever, the axis passing through a center position on the tip side in the resilient piece approaches the axis passing through a center position on the base end side. Thus, a displacement amount of the resilient piece is larger as compared to the case where the axis passing through the center position on the tip side in the resilient piece and the axis passing through the center position on the base end side are located on the same axis, and the resilient piece more easily enters the clearance between the projecting wall and the outer surface of the housing.

DETAILED DESCRIPTION

A specific example of the lever-type connector of the disclosure is described below with reference to the drawings. Note that the present invention is not limited to these illustrations and is intended to be represented by claims and include all changes in the scope of claims and in the meaning and scope of equivalents.

Figure 1:
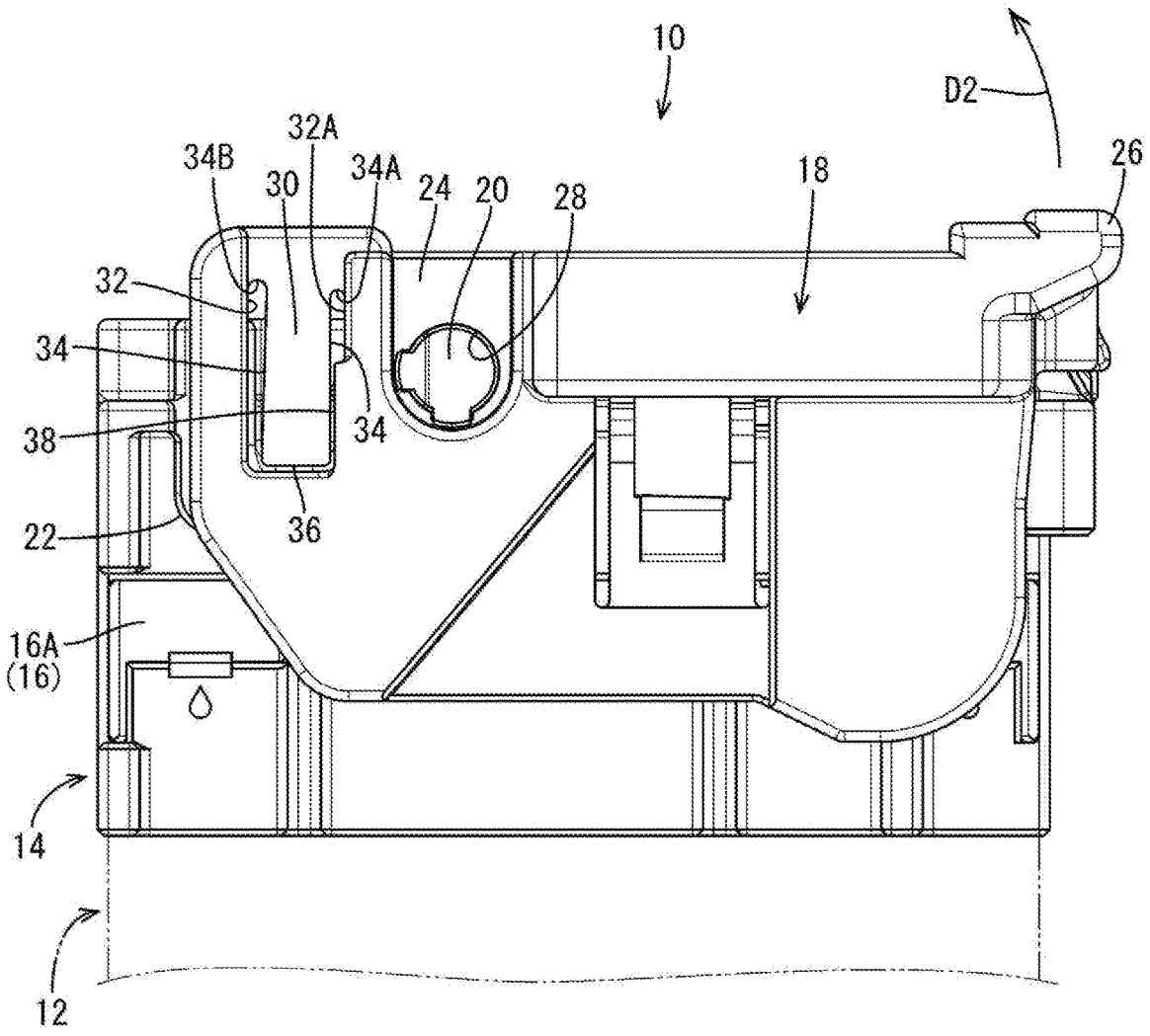
FIG. 1 is a plan view of a lever-type connector according to an embodiment showing a state where a lever is located at a connection end position.
Figure 2:
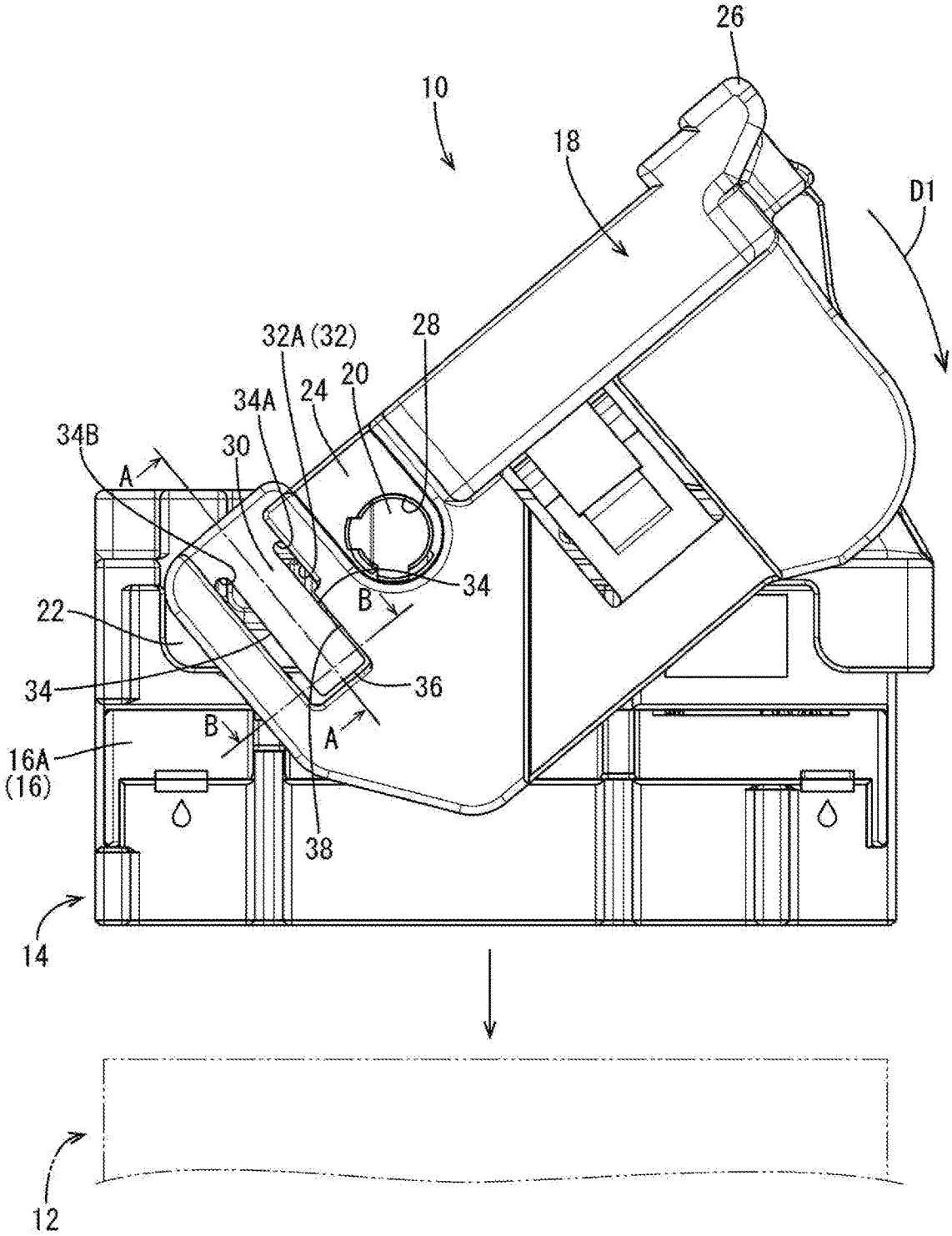
FIG. 2 is a plan view of the lever-type connector showing a state where the lever is located at an initial position.

A lever-type connector 10 in this embodiment includes, as shown in FIGS. 1 and 2, a female housing 14 to be connected to a male housing (mating housing) 12 and a lever 18 to be mounted on an outer surface 16 of the female housing 14. The lever 18 is rotatable between an initial position and a connecting end position. The initial position of the lever 18 is shown in FIG. 2 and is the position where the lever 18 is located before the connection of the female housing 14 and the male housing 12 is started. The connection end position of the lever 18 is shown in FIG. 1 and is the position where the lever 18 is located when the connection of the female housing 14 and the male housing 12 is completed. In the following description, a connecting direction of the female housing 14 (direction from an upper side toward a lower side in FIGS. 1 and 2) is a forward direction, and a separating direction is a rearward direction. Further, a direction from a lower surface 16B toward an upper surface 16A in the female housing 14 in FIG. 4 is an upward direction, and a direction from a left side toward a right side in FIGS. 1 and 2 is a rightward.

Figure 4:
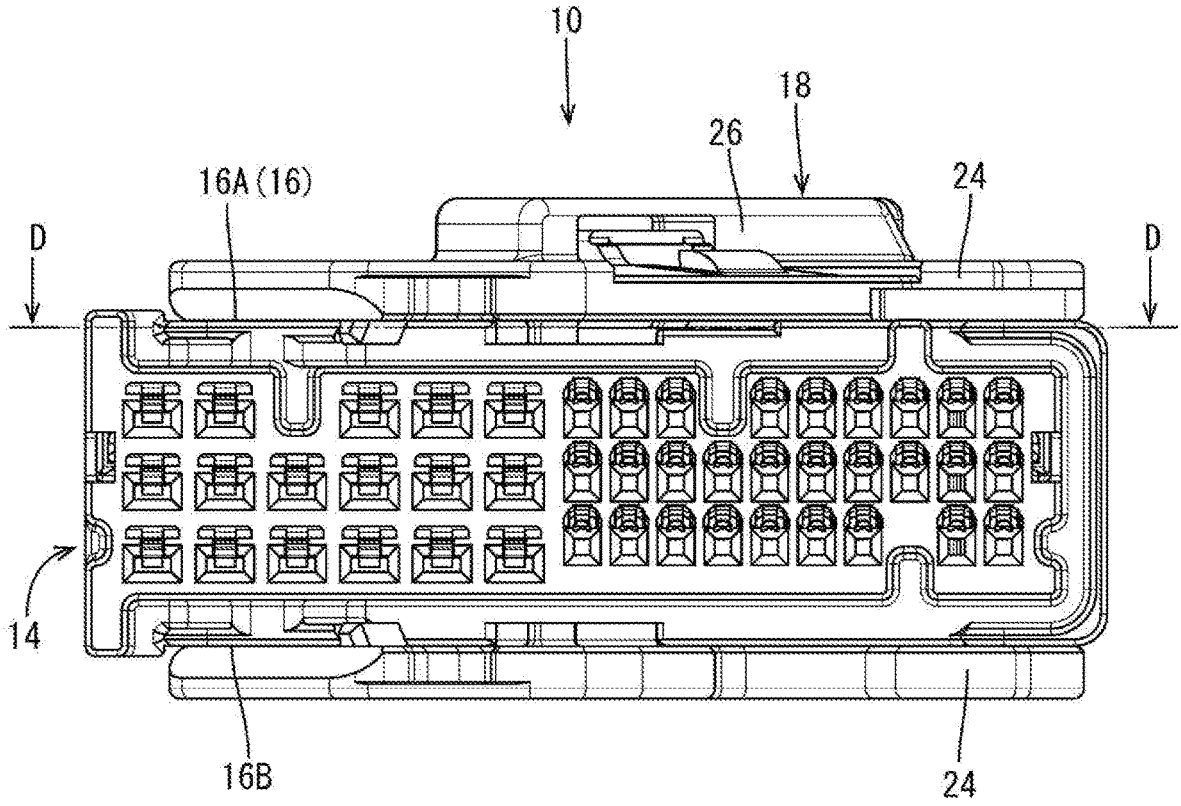
FIG. 4 is a front view of the lever-type connector.

The female housing 14 is made of synthetic resin and has a flat rectangular parallelepiped shape, as shown in FIGS. 2 and 4. Cavities for accommodating female terminals (not shown) are open in the front surface of the female housing 14.

Figure 5:
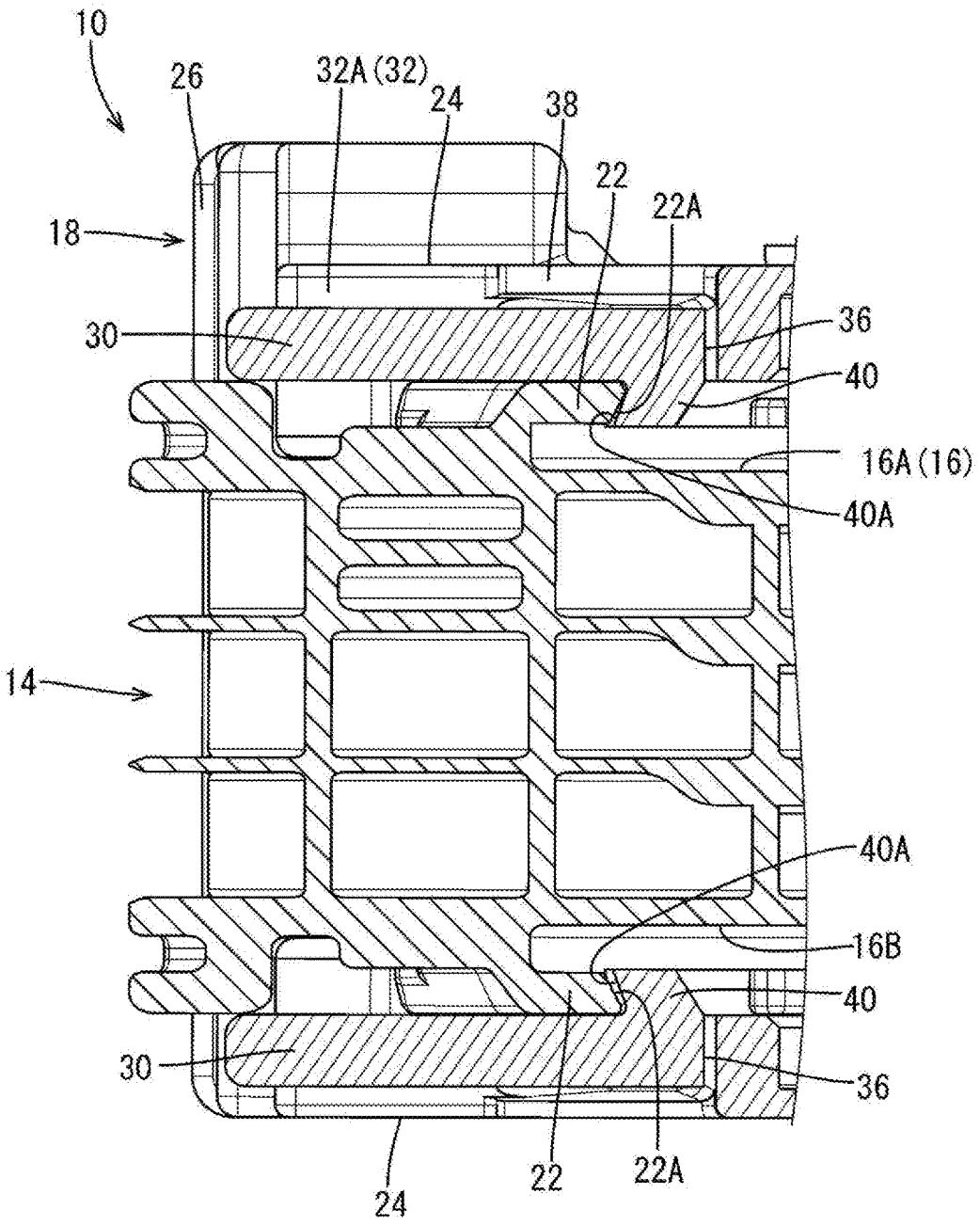
FIG. 5 is a section along A-A in FIG. 2.

As shown in FIGS. 1 and 2, a shaft 20 and a locked portion 22 are provided on the upper surface 16A of the outer surface 16 of the female housing 14. As shown in FIG. 5, the locked portion 22 projects up from the upper surface 16A. Further, a shaft (not shown) and a locked portion 22 similarly are provided on the lower surface 16B of the outer surface 16 of the female housing 14.

As shown in FIG. 5, the lever 18 includes upper and lower arm plates 24, which are coupled to each other by an operating portion 26. The arm plates 24 are disposed parallel to the upper and lower surfaces 16A, 16B of the female housing 14. In the following description of the arm plates 24, only the arm plate 24 on the side of the upper surface 16A of the female housing 14 is described. The arm plate 24 on the lower surface 16B is not described, but the components that are the same as those of the arm plate 24 on the upper surface 16A are denoted by the same reference signs.

As shown in FIGS. 1 and 2, a shaft hole 28 is open in the arm plate 24 and is to be fit to the shaft 20 of the female housing 14, and the lever 18 is rotatable in rotating directions D1, D2 about the shafts 20 with respect to the female housing 14. The rotating direction D1 is a direction for rotating the lever 18 from the initial position to the connection end position, and the rotating direction D2 is a direction for returning the lever 18 from the connection end position to the initial position.

As shown in FIG. 1, a U-shaped slit is provided in the arm plate 24 to the left of the shaft hole 28, and a resilient piece 30 is formed by this slit. The resilient piece 30 is cantilevered and resiliently displaceable in a vertical direction. Parts located on both left and right sides of the peripheral edge of the resilient piece 30 define side edges 34 and a part on a tip coupling the pair of side edges 34 to each other is a tip edge 36.

Figure 7:
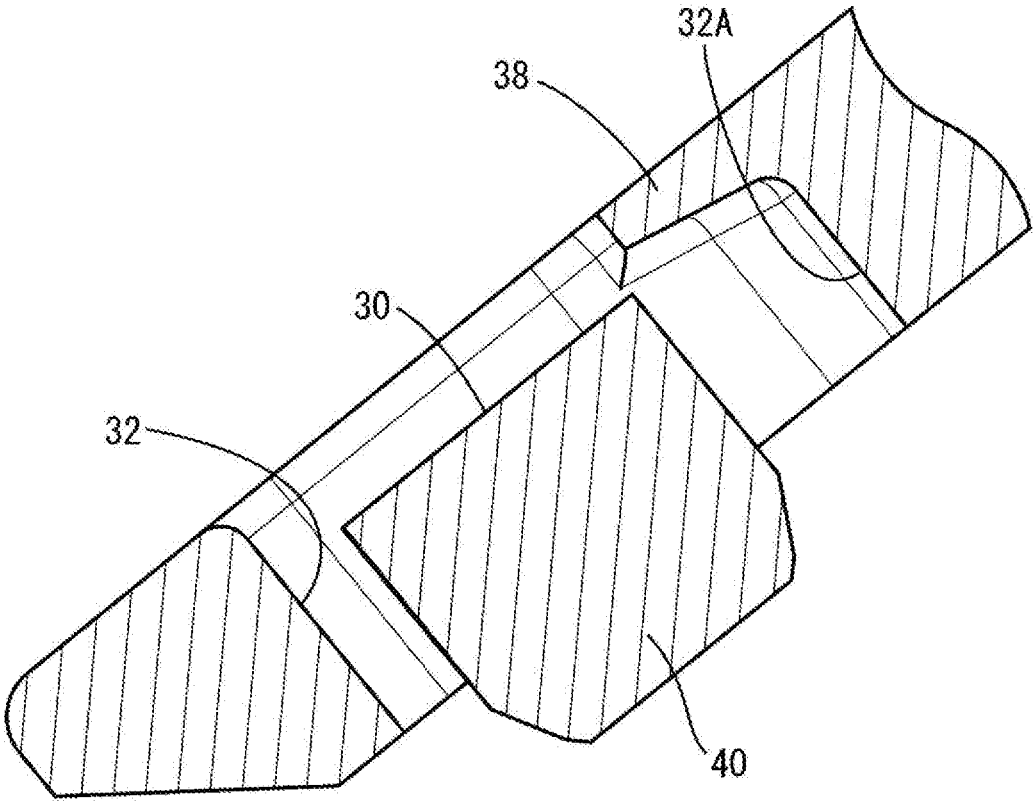
FIG. 7 is a section along B-B in FIG. 2.
Figure 8:
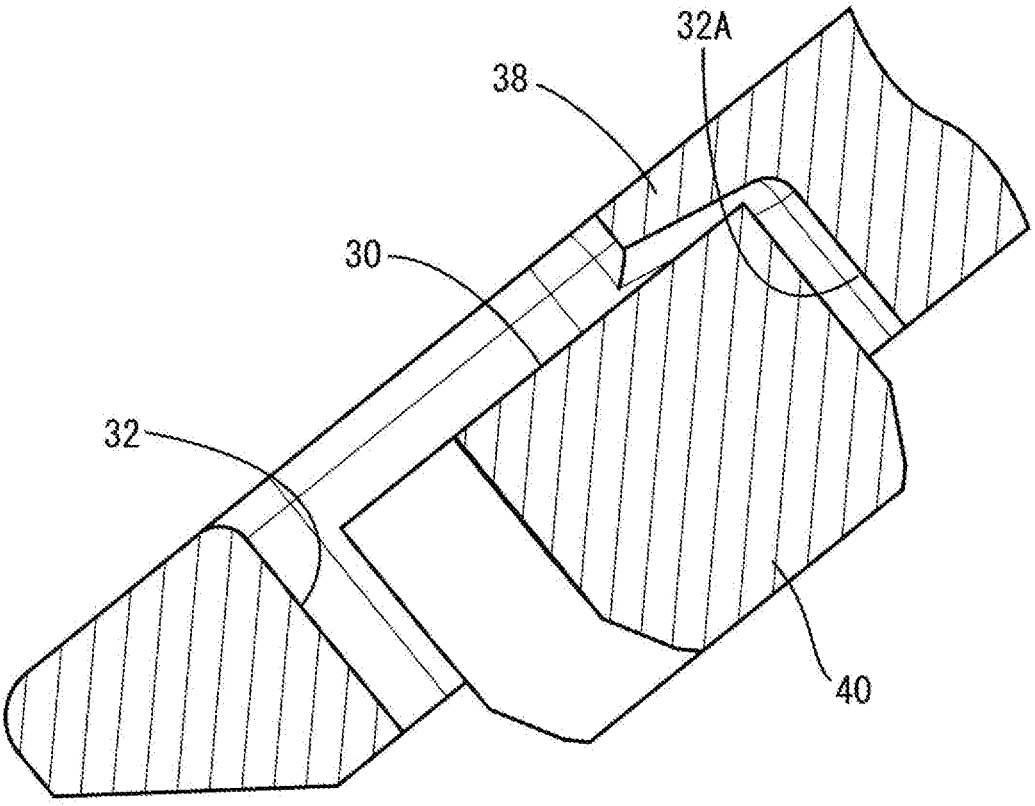
FIG. 8 is a section along C-C in FIG. 3.
Figure 9:
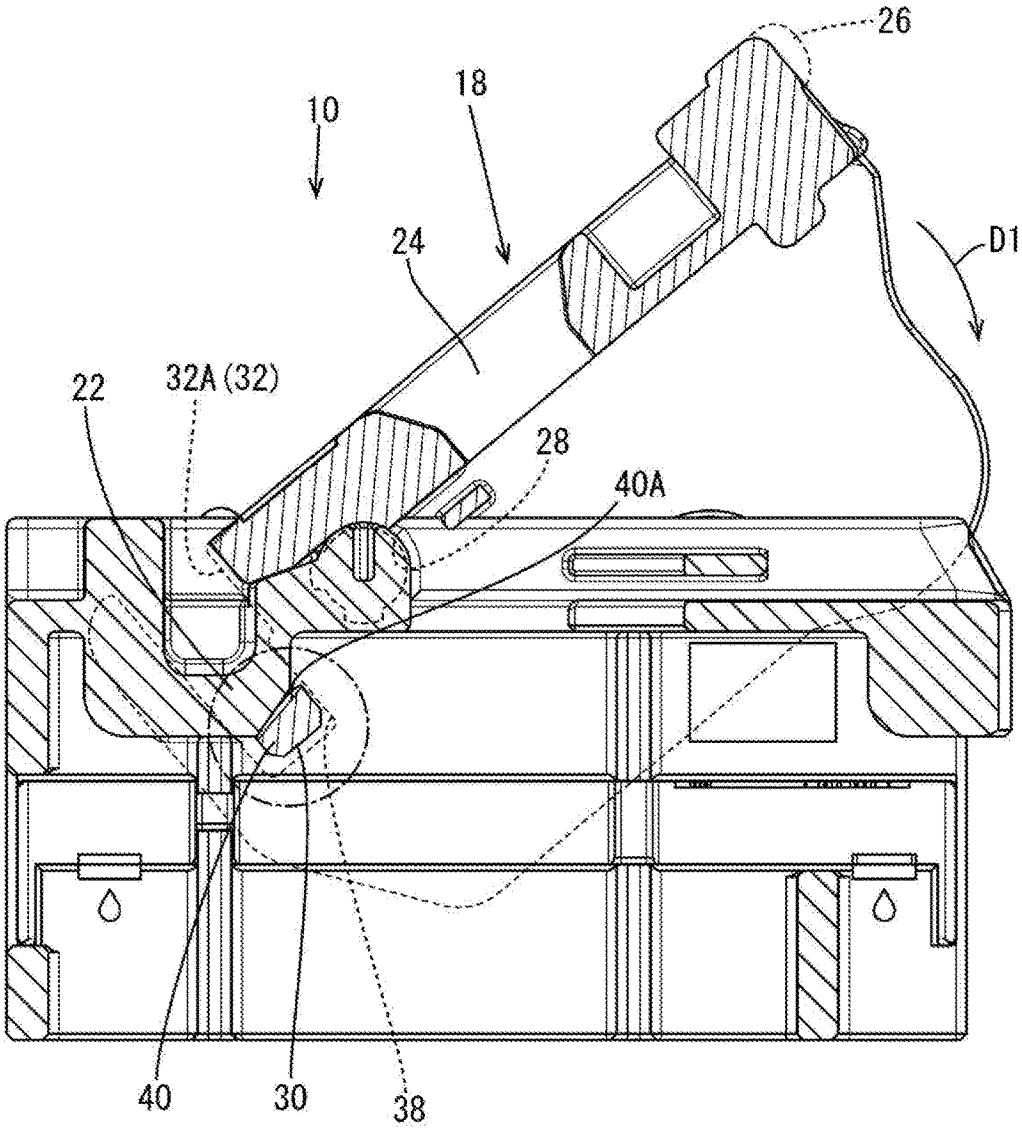
FIG. 9 is a section along D-D in FIG. 4.

As shown in FIGS. 1 and 2, a peripheral wall 32 surrounds the resilient piece 30 of the arm plate 24 and faces each of the side edges 34 and the tip edge 36 of the resilient piece 30. A projecting wall 38 projects toward the resilient piece 30 on a peripheral wall 32A near the shaft hole 28. As shown in FIGS. 7 and 8, the projecting wall 38 is located above the resilient piece 30 and has a tapered shape such that the lower surface of the projecting wall 38 is inclined up from a base end toward the tip of the projecting wall 38.

Figure 12:
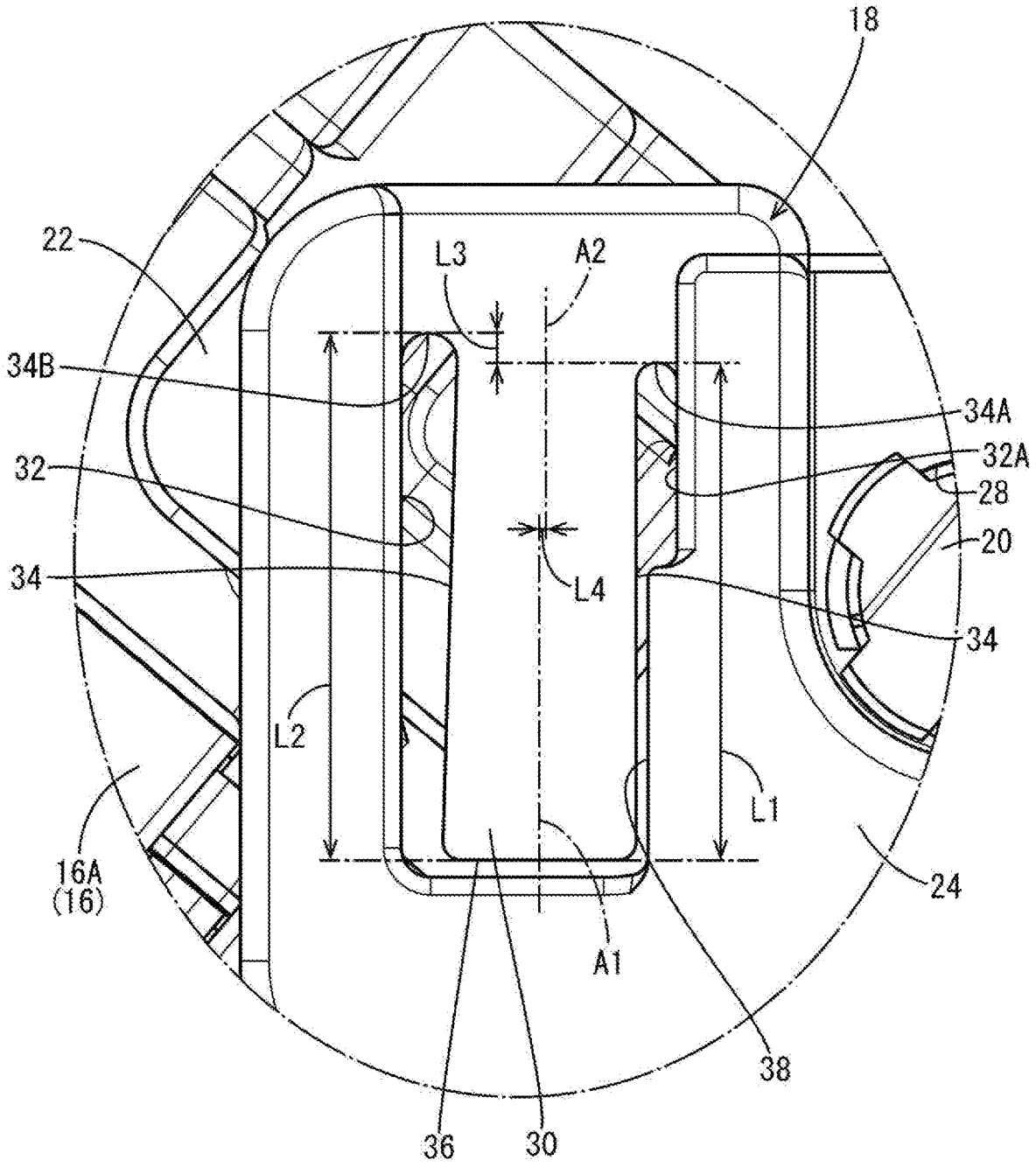
FIG. 12 is an enlarged view near a resilient piece in FIG. 2.

As shown in FIG. 12, a base end 34A of the side edge 34 of the resilient piece 30 near the projecting wall 38 is closer to the tip edge 36 than a base end 34B of the side edge 34 distant from the projecting wall 38. Thus, a length L2 from the base end 34B to the tip edge 36 is longer than a length L2 from the base end 34A to the tip edge 36 by a length L3.

As shown in FIG. 12, the resilient piece 30 becomes wider from the the base ends 34A, 34B toward the tip edge 36, and an axis A1 passing through a center on the side of the tip edge 36 in the resilient piece 30 is separated more in a direction away from the projecting wall 38 than an axis A2 passing through a center on the side of the base ends 34A, 34B in the resilient piece 30 by a length L4.

Figure 6:
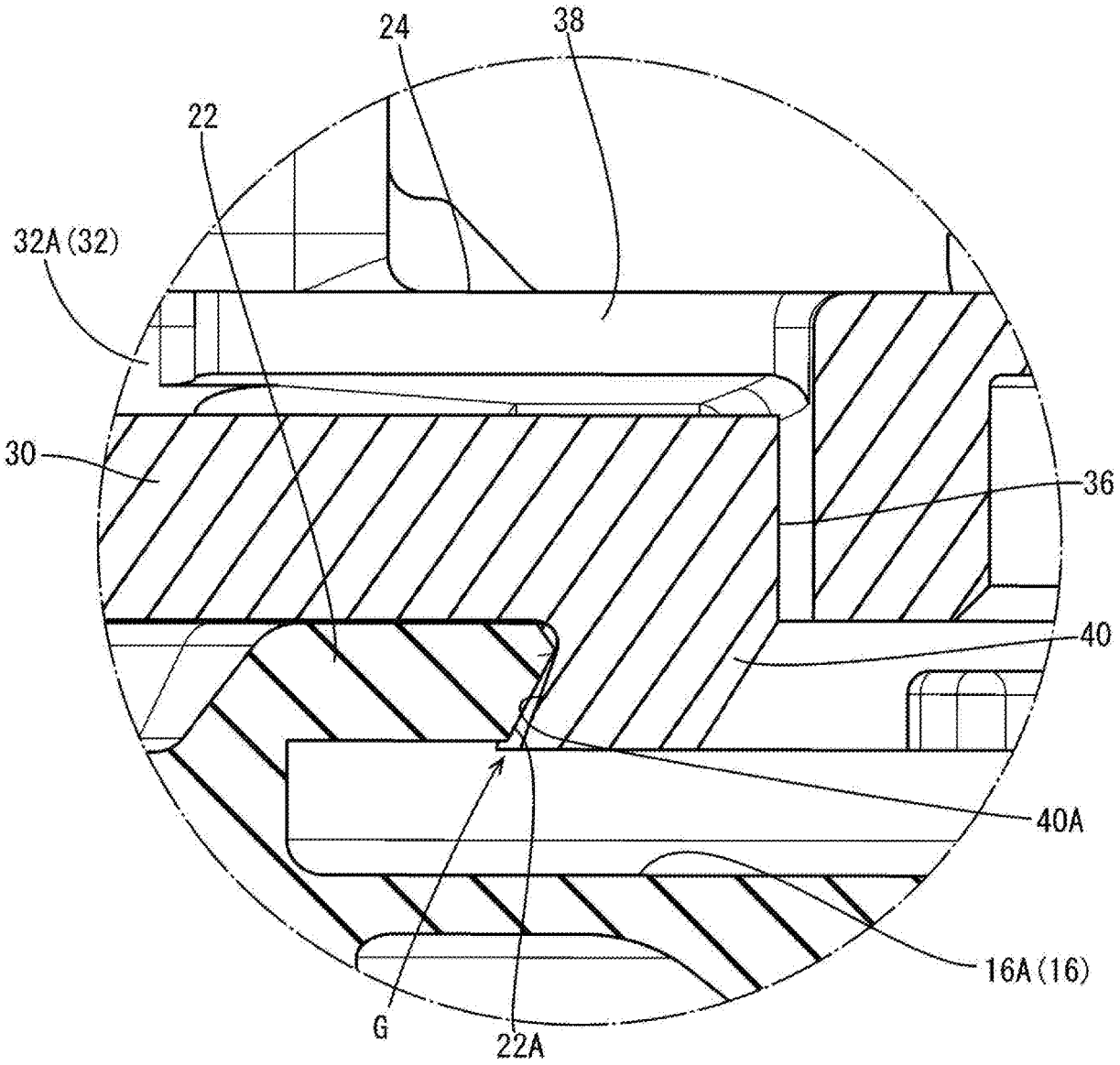
FIG. 6 is an enlarged view near a locking surface and a locked surface in FIG. 5.
Figure 10:
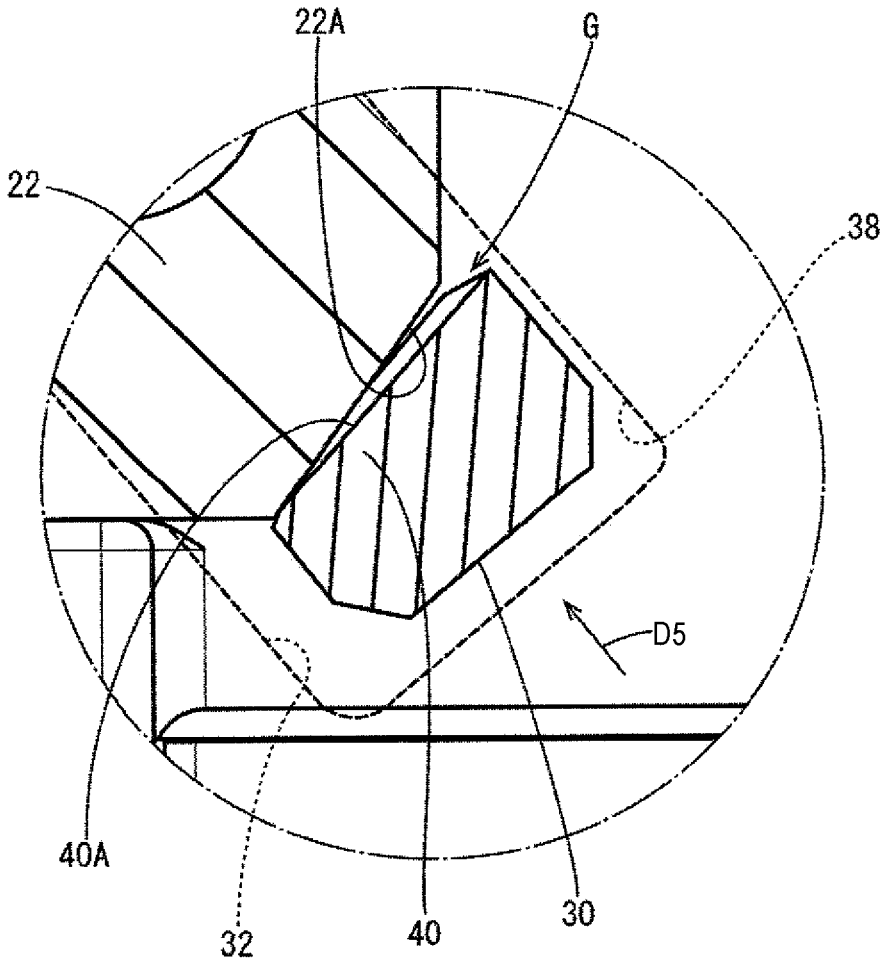
FIG. 10 is an enlarged view of the locking surface and the locked surface in FIG. 9.

As shown in FIGS. 5 and 6, a lock 40 projects down at the tip edge 36 of the resilient piece 30. The lock 40 has a locking surface 40A facing the locked portion 22 in the female housing 14 at the initial position. Further, the locked portion 22 has a locked surface 22A facing the locking surface 40A on the lock 40. If the lever 18 at the initial position is rotated in the rotating direction D1 toward the connection end position, as shown in FIG. 2, the locking surface 40A on the lock 40 contacts the locked surface 22A on the locked portion 22 from the rotating direction D1, as shown in FIG. 10. In this way, the locking surface 40A of the lock 40 is locked to the locked surface 22A of the locked portion 22 to suppress rotation of the lever 18 from the initial position toward the connection end position.

As shown in FIGS. 5 and 6, the locking surface 40A is reverse-tapered to be inclined toward the base end (left side in FIGS. 5 and 6) of the resilient piece 30 while approaching the upper surface 16A in the female housing 14 (as moving downward).

As shown in FIG. 6, the locking surface 40A is oblique to the locked surface 22A so as to start contacting the locked surface 22A from an outer side distant from the shaft hole 28 at the initial position. In this way, a gap G is formed between the locking surface 40A and the locked surface 22A, as shown in FIG. 10.

Insertion of the male housing 12 into the female housing 14 causes an unlocking portion in the male housing 12 to push up the lock 40 on the resilient piece 30 and to unlock the lock 40 from the locked portion 22 so that the lever 18 can rotate in the rotating direction D1. Connection of the male and female housings 12 and 14 is completed by rotating the lever 18 in the rotating direction D1 from the initial position to the connection end position.

Next, an operation of rotating the lever 18 of this embodiment from the initial position toward the connection end position is described.

Figure 3:
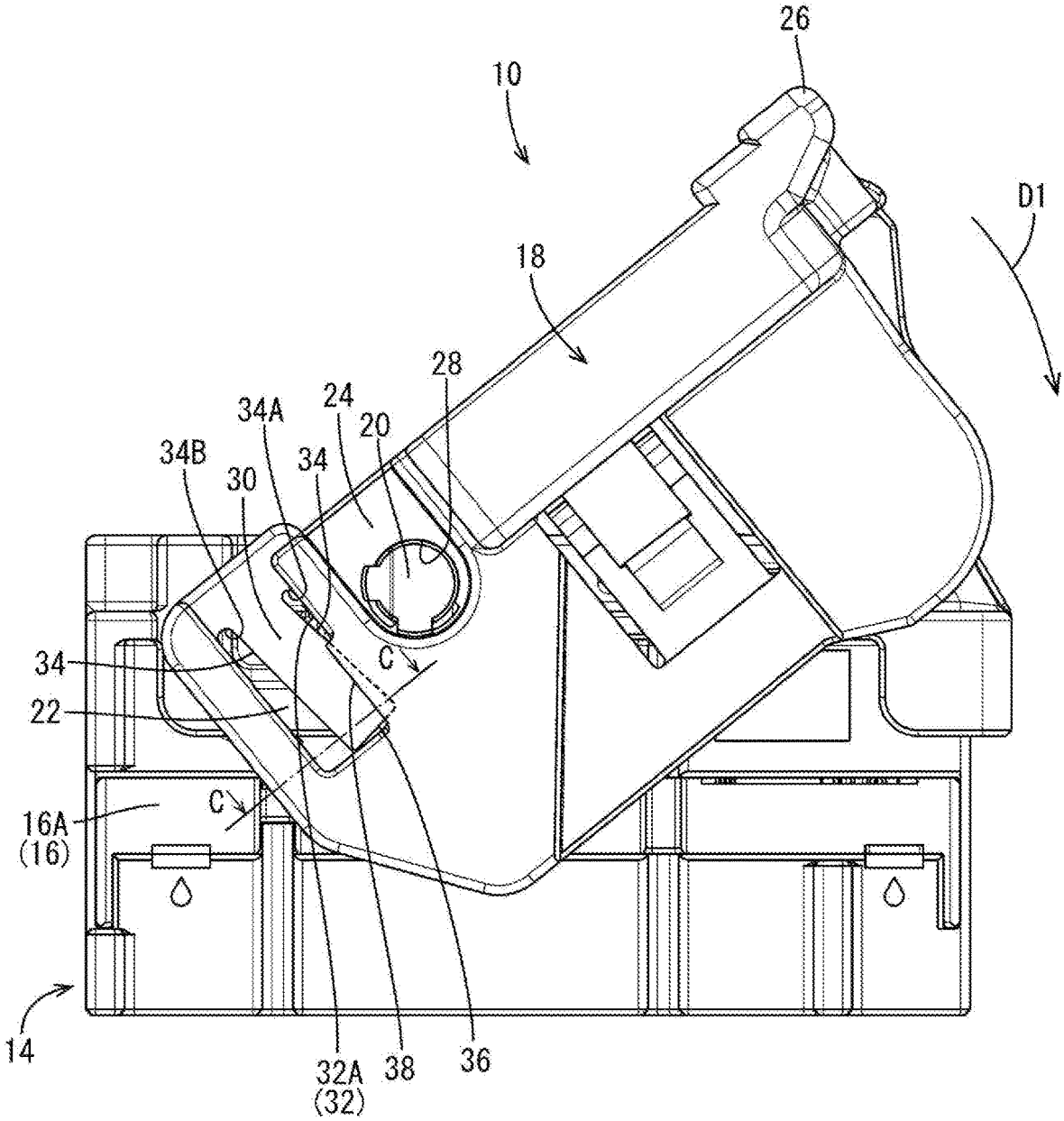
FIG. 3 is a plan view of the lever-type connector showing a state where the lever at the initial position is strongly rotated.
Figure 11:
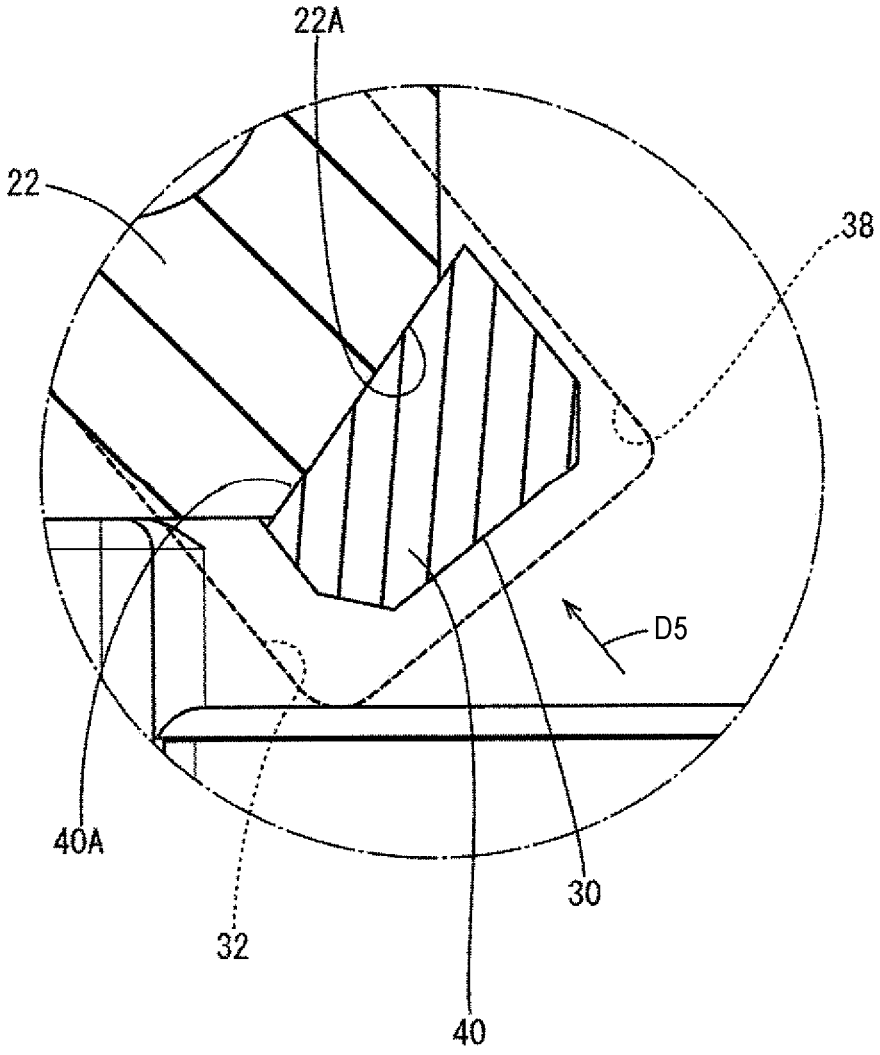
FIG. 11 is a section, corresponding to FIG. 10, showing the state where the lever at the initial position is strongly rotated.

If the lever 18 is rotated strongly in the rotating direction D1, as shown in FIG. 3, the locking surface 40A on the resilient piece 30 strongly comes into line contact with the locked surface 22A to eliminate the gap G, as shown in FIG. 11. At this time, the resilient piece 30 is pulled strongly in a direction D5 (see FIGS. 10 and 11) from the base end toward the tip, and the axis A1 on the side of the tip edge 36 in the resilient piece 30 approaches the axis A2 on the base end, as shown in FIG. 12. Thus, the resilient piece 30 deflects a large amount toward the projecting wall 38 and enters a clearance between the projecting wall 38 and the upper surface 16A of the female housing 14, as shown in FIGS. 3 and 8. Disposition of the axis A1 farther from the projecting wall 38 than the axis A2 enables the resilient piece 30 to deflect more easily toward the projecting wall 38 than if the axes A1 and A2 are aligned.

If the resilient piece 30 is urged upward while being in the clearance between the projecting wall 38 and the upper surface 16A of the female housing 14, the resilient piece 30 contacts the projecting wall 38 from below to suppress an upward displacement. In this way, locking between the locking surface 40A on the resilient piece 30 and the locked surface 22A is not released even if the lever 18 is rotated strongly.

A tensile load is applied to the side edge 34B of the resilient piece 30 distant from the projecting wall 38 and a compressive load is applied to the base end 34A of the near side edge 34 when the resilient piece 30 is in the clearance between the projecting wall 38 and the upper surface 16A of the female housing 14. Generally, resin is weaker against a tensile load than against a compressive load and is broken easily by a tensile load. Here, the length L2 of the side edge 34 distant from the projecting wall 38 from the base end 34B to the tip is longer than the length L1 of the side edge 34 near the projecting wall 38 from the base end 34A to the tip, as shown in FIG. 12. Thus, a tensile load applied to the base end 34B of the side edge 34 distant from projecting wall 38 is dispersed in a wider range, and the tensile load is less likely to break the resilient piece 30.

As described above, the locking surface 40A of the resilient piece 30 is locked to the locked surface 22A of the female housing 14 to suppress rotation of the lever 18 from the initial position toward the connection end position.

The lever at the initial position may be urged strongly toward the connection end position, thereby creating a concern that the locking surface 40A of the resilient piece 30 will separate from the locked surface 22A. However, the locking surface 40A of the resilient piece 30 has a reverse-taper to incline toward the base end while approaching the upper surface (outer surface) 16A of the female housing 14 to suppress separation of the locking surface 40A from the locked surface 22A. As a result, the resilient piece 30 can enter the clearance between the projecting wall 38 and the upper surface 16A of the female housing 14, and separation of the locking surface 40A from the locked surface 22A also can be suppressed by the projecting wall 38. Thus, the lever 18 is held reliably at the initial position.

The lever 18 includes the shaft hole 28 that receives the shaft 20 projecting on the upper surface 16A of the female housing 14. The locking surface 40A is oblique to the locked surface 22A to start locking the locked surface 22A from the outer side distant from the shaft hole 28 at the initial position. Thus, the gap G is formed between the locking surface 40A and the locked surface 22A at the initial position, but the resilient piece 30 is pushed toward the clearance between the projecting wall 38 and the upper surface 16A of the female housing 14 when the lever 18 is rotated strongly. Therefore, the gap G is eliminated, and the locking surface 40A and the locked surface 22A are locked strongly to each other. Accordingly, a locked state of the locking surface 40A and the locked surface 22A is maintained even if there is a large force as to separate the locking surface 40A from the locked surface 22A.

Further, the resilient piece 30 has the two side edges 34 and the tip edge 36 coupling the tips of the side edges 34 to each other. The base end 34A of the side edge 34 near the projecting wall is closer to the tip edge 36 than the base end 34B of the side edge 34 distant from the projecting wall. By employing this configuration, a tensile load is applied to the side edge 34 distant from the projecting wall 38, and a compressive load is applied to the side edge 34 near the projecting wall 38 when the resilient piece 30 is deflected toward the projecting wall 38. Generally, resin is weaker against a tensile load than against a compressive load and easily is broken by a tensile load. However, the base end 34A of the side edge 34 near the projecting wall 38 is closer to the tip edge 36 than the base end of the side edge 34 distant from the projecting wall 38 so that the length L2 of the side edge 34 distant from the projecting wall 38 from the base end 34B to the tip is longer than the length L1 of the side edge 34 near the projecting wall 38 from the base end 34A to the tip. Thus, a tensile load applied to the base end 34B of the side edge 34 distant from projecting wall 38 is dispersed in a wider range and is not likely to break the resilient piece 30.

The resilient piece 30 is provided so that the axis A1 passing through the center on the tip side is more distant from the projecting wall 38 than the axis A2 passing through the center on the base end side. With this configuration, the axis A1 passing through a center position on the tip side in the resilient piece 30 approaches the axis A2 passing through a center position on the base end side when the resilient piece 30 is pulled strongly by rotation of the lever 18. Thus, a displacement amount of the resilient piece 30 is larger as compared to the case where the axis A1 passing through the center on the tip side in the resilient piece 30 and the axis A2 passing through the center position on the base end side are aligned, and the resilient piece 30 more easily enters the clearance between the projecting wall 38 and the upper surface (outer surface) 16A of the housing.

The invention is not limited to the above described and illustrated embodiment. For example, the following various modes also are included.

Although the lock 40 is located on the side of the tip edge 36 of the resilient piece 30 in the above embodiment, there is no limitation to this. For example, a lock may be located in a center between a tip edge and a base end of a resilient piece.

The resilient piece 30 is provided in each of the arm plates 24 in the above embodiment. However, a resilient piece may be provided only in one arm plate.

The lever-type connector 10 is the female lever-type connector 10 with the female housing 14 in the above embodiment. However, the above-described configuration may be applied to a male lever-type connector.

LIST OF REFERENCE SIGNS

10: lever-type connector
12: male housing (mating housing)

14: female housing (housing)
16: outer surface
16A: upper surface
16B: lower surface
18: lever
20: shaft
22: locked portion
22A: locked surface
24: arm plate
26: operating portion
28: shaft hole
30: resilient piece
32, 32A: peripheral wall
34: side edge
34A, 34B: base end
36: tip edge
38: projecting wall
40: lock
40A: locking surface
A1, A2: axis
G: gap

What is claimed is:

1. A lever-type connector, comprising:

a housing to be connected to a mating housing; and a lever mounted on an outer surface of the housing and rotatable between an initial position where the lever is located before connection to the mating housing is started and a connection end position where the lever is located when the connection to the mating housing is completed, wherein:

the lever includes:

a resilient piece cantilevered parallel to the outer surface of the housing; and a projecting wall projecting toward the resilient piece from a peripheral wall surrounding the resilient piece, the resilient piece has a locking surface extending toward a base end of the resilient piece while approaching the outer surface of the housing, the housing has a locked surface extending toward a tip of the resilient piece with distance from the outer surface of the housing, and the resilient piece enters a clearance between the projecting wall and the outer surface of the housing when the lever is rotated from the initial position to the connection end position with the locking surface and the locked surface locked to each other.

2. The lever-type connector of claim 1, wherein the resilient piece has two side edges and a tip edge coupling tips of the side edges to each other, and a base end of the side edge near the projecting wall is located closer to the tip edge than a base end of the side edge distant from the projecting wall.

3. The lever-type connector of claim 1, wherein the resilient piece is provided so that an axis passing through a center on a tip side is more distant from the projecting wall than an axis passing through a center on a base end.

4. The lever-type connector of claim 1, wherein:

the lever includes a shaft hole into which a shaft projecting on the outer surface of the housing is fit, and the locking surface is oblique to the locked surface to start locking the locked surface from an outer side distant from the shaft at the initial position.

5. The lever-type connector of claim 4, wherein the resilient piece has two side edges and a tip edge coupling tips of the side edges to each other, and a base end of the side edge near the projecting wall is located closer to the tip edge than a base end of the side edge distant from the projecting wall.

6. The lever-type connector of claim 5, wherein the resilient piece is provided so that an axis passing through a center on a tip side is more distant from the projecting wall than an axis passing through a center on a base end.

* * * * *